United States Patent [19]

Itoh et al.

[11] Patent Number: 4,472,615

[45] Date of Patent: Sep. 18, 1984

[54] CONTACT SWITCHING DEVICE

[75] Inventors: Katsuaki Itoh, Itami; Yuji Mihara, Osaka, both of Japan

[73] Assignee: Mitsubishi Denki Kabushiki Kaisha, Tokyo, Japan

[21] Appl. No.: 522,731

[22] Filed: Aug. 12, 1983

[30] Foreign Application Priority Data

Aug. 12, 1982 [JP] Japan ..... 57-141468

[51] Int. Cl.[3] ..... H01H 3/04

[52] U.S. Cl. ..... 200/153 G; 200/73; 200/244

[58] Field of Search ..... 200/153 G, 153 N, 244, 200/337, 48 KB, 153 H, 67 A, 73

[56] References Cited

U.S. PATENT DOCUMENTS

| | | | |
|---|---|---|---|
| 320,017 | 6/1885 | Thomson et al. | 200/153 G |
| 2,601,422 | 6/1952 | Thumim | 200/244 |
| 3,013,143 | 12/1961 | Hayden | 200/153 H |
| 3,264,420 | 8/1966 | Charbonneau | 200/153 G |

*Primary Examiner*—John W. Shepperd
*Assistant Examiner*—Renee S. Kidorf
*Attorney, Agent, or Firm*—Wenderoth, Lind & Ponack

[57] ABSTRACT

A contact switching device has a driving link pivoted on its one end, a spring loaded slide slidably disposed within a longitudinal guide groove disposed on the other end portion of the driving link, a connecting link pivoted at one end on the slide and at the other end on an intermediate point of a driven link pivoted on its one end and having a movable contactor disposed on the other end portion of the driven link to separably engage two stationary contacts. Alternatively two connecting links having equal lengths may be pivoted at one end on the slide and at the other ends on respective driven links at points equidistant from the pivot on which the driven links are pivoted. The driven links have equal length and movable contactors for separably engaging pairs of stationary contacts. The contact of one pair is connected to one contact of the other pair.

4 Claims, 12 Drawing Figures

CONTACT SWITCHING DEVICE

BACKGROUND OF THE INVENTION

This invention relates to a contact switching device.

It is well known that vacuum switches are advantageous in that the interrupting performance is excellent, contacts have a long lifetime and disadvantageous in that as the number of current switchings increases, the dielectric strength across the gap is not only decreased but also becomes unstable. It is also widely known that in on-load tap changers, adjacent taps may have generated thereacross impulse voltages reaching several tens the normal voltage thereacross due to lightning strokes invading the mating transformer windings. Therefore when vacuum switches are used as elements for switching currents through on-load tap changers, it is important that the disadvantages of the vacuum switch be compensated for and that the best use be made of the advantages thereof. Thus there are provided in various circuit systems and are used as a diverter switch for performing complicated and special operations.

Accordingly it is an object of the present invention to provide a new and improved contact switching device which can easily operate as a diverter switch to perform the complicated and special operation.

SUMMARY OF THE INVENTION

The present invention provides a contact switching device comprising a driving link capable of reciprocally rotating about a first center of rotation at one end thereof, at least one driven link capable of reciprocally rotating about a second center of rotation different from the first center of rotation and including a movable contactor, at least one connecting link pivotally secured at one end to the driven link at a point different from the second center of rotation and at the other end to the other end of the driving link so as to be receiprocally rotatable about the other end therefor, and stationary contact means separably engaged by the movable contactor.

In a preferred embodiment of the present invention, the driving link may include a longitudinally extending guide groove on the other end portion, a slide slidably disposed within the guide groove and pivotally secured to the other end of the connecting link, and a resilient member disposed within the guide groove tending to push the slide toward the other end of the driving link.

BRIEF DESCRIPTION OF THE DRAWINGS

The present invention will become more readily apparent from the following detailed description taken in conjunction with the accompanying drawings in which.

DESCRIPTION OF THE PREFERRED EMBODIMENTS

Figure 1:
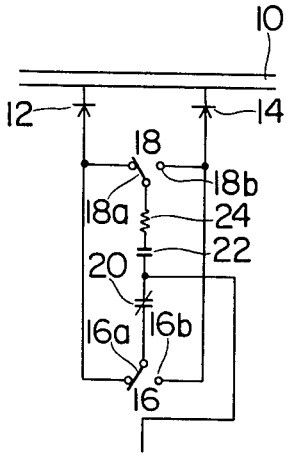
FIG. 1 is a fragmental circuit diagram of an on-load tap changer.

Referring now to FIG. 1 of the drawings, there is illustrated an on-load tap changer using a plurality of vacuum switches. The arrangement illustrated comprises a tapped winding 10 of a transformer, an even-numbered tap 12, an odd-numbered tap 14 adjacent to the even-numbered tap 12, a first and a second stationary contact 16*a* and 16*b* of a diverter switch 16 connected to the taps 12 and 14 respectively, and a first and a second stationary contact 18*a* and 18*b* of an after-closure switch 18 connected to the taps 12 and 14 respectively. An arcing contact pair 20, a resistance contact pair 22 and a current limiting resistor 24 are series connected to one another in the named order between the diverter switch 16 and the after-closure switch 18 with the junction of the contact pairs 20 and 22 connected to a current utilization device (not shown). Each of the arcing and resistance contact pairs 20 and 22 respectively is constituted by a vacuum switch.

Figure 2A:
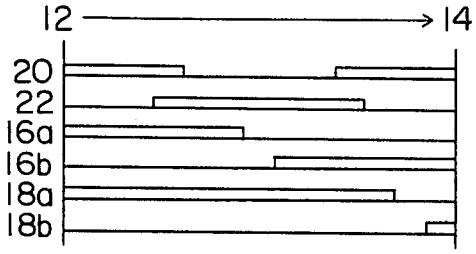
FIG. 2A is the graph illustrating a switching sequence in which the switches disposed in the arrangement shown in FIG. 1 are successively operated for the diversion of a load current effected in one direction.
Figure 2B:
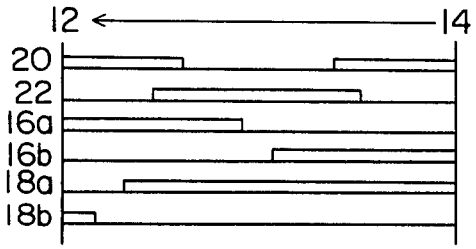
FIG. 2B is a graph similar to FIG. 2A but illustrating a switching sequence for the arrangement shown in FIG. 3 with the diversion of the load current effected in the opposite direction.

As shown in FIG. 1, the series connected contact pairs 20 and 22 and the resistor 24 are connected to the odd-numbered tap 12 through the first contact 16*a* to cause a load current to flow through that tap 12. It is assumed that the current utilization device now connected to the odd-numbered tap 12 is to be connected to the even-numbered tap 14 by the operations of the switches 16 and 18. Under assumed conditions, the arcing and resistance contact pairs 20 and 22, the first and second diverter contacts 16*a* and 16*b* and the first and second after-closure contacts 18*a* and 18*b* have currents flowing therethrough in accordance with a switching sequence as shown in FIG. 2A. Upon diverting the load current from the tap 14 to the tap 12, the current flows through the abovementioned components in accordance with a switching sequence as shown in FIG. 2B. In each of FIGS. 2A and 2B, each row indicates the current flowing through a different one of the abovementioned components designated by the same reference numeral denoting the row. For example, FIG. 2A shows that between the end of a flow of current through the contact 16*a* and the initiation of a flow of current through the contact 16*b* a short time interval exists during which no current flows through either the contact 16*a* or the contact 16*b*.

In the arrangement of FIG. 1, the diverter switch 16 and the after-closure switch 18 are operated to prevent a voltage across the taps 12 and 14 from being applied to the arcing and resistance contact pairs 20 and 22 respectively at each of the tap positions. This eliminates problems of the dielectric strength across the contacts in the arching and resistance contact pairs 20 and 22 respectively constituted by vacuum switches. Thus the advantages of the vacuum switch are preserved. During the use of the arrangement of FIG. 1, however, there have been encountered the following problems:

In on-load tap changers of the resistance type, the diverter switch includes a quick motion mechanism disposed on a driving shaft for operating the switch to effect a rocking and rotating movement of the driving shaft at a high speed through a predetermined angle. At that time, it is seen from FIGS. 2A and 2B that the first and second stationary contacts 16*a* and 16*b* of the diverter switch 16 are required to be prevented from being operated during a substantial portion of the rotating movement of the driving shaft through the predetermined angle and also to be opened and closed within a time interval as short as possible, respectively, and vice versa, while at the same time the contact opening operation is required to open the contacts as far as possible in order to ensure an electrically insulating distance in excess of that suitable for a voltage across the taps for the short pause time interval as described above.

In order to meet the rquirements as described above, the present invention provides a contact switching device comprising a driving link including a longitudinal guide groove radially closed at both ends and reciprocally rotatable about a center of rotation at one end thereof, a slide slidably disposed within the guide groove, a driven link including a movable contactor and reciprocally rotatable about a center of rotation different from that for the driving link, a connecting link pivotally secured at one end to the driven link at a position different from the second center of rotation and at the other end to the slide, and a resilient member for pushing the slide in the direction of a centrifugal force provided by the driving link or toward the other end of the driving link.

Figure 3:
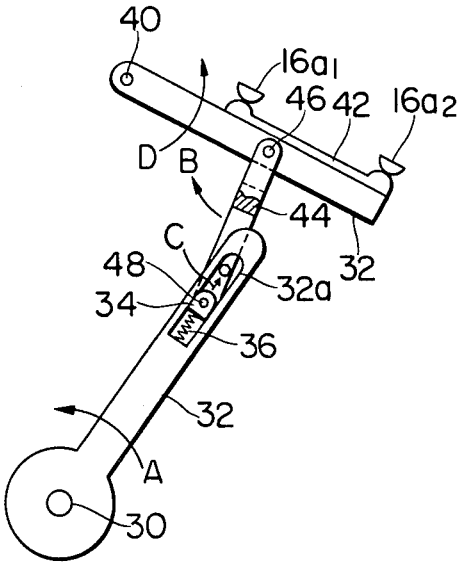
FIG. 3 is a front plan view of one embodiment of the contact switching device according to the present invention.

Referring now to FIG. 3 there is illustrated one embodiment of the contact switching device of the present invention. The arrangement illustrated comprises a driving shaft 30, and a driving link 32 fixed at one end to the driving shaft 30. The driving shaft 30 is arranged to reciprocally rotate through a predetermined angle to be capable of effecting a reciprocally rotating movement of the driving link 32 about the axis of the driving shaft 30, i.e. a first center of rotation at the one end thereof. Also the driving link 32 is connected to a quick motion mechanism (not shown) and is provided on the other end portion with a longitudinally extending guide groove 32*a* closed at both radial ends. A slide 34 is slidably disposed within the guide groove 32*a* and pushed toward the other end of the driving link 32, i.e. in the direction of the centrifugal force acting on the driving link 32 due to its being rotated, by means of a resilient member, in this case, a compressible spring 36 disposed within the guide groove 32*a*.

A driven link 38 is disposed to be reciprocally rotatable about a second center of rotation 40 different from the axis of the driving shaft 30 or the first center of rotation and has a movable contactor 42 fixed to the free end thereof and provided at both ends with a pair of contact-shaped portions. Also a connecting link 44 is pivotally secured at one end to an intermediate point on the driven link 38 by a pivot pin 46 and at the other end to the slide 34 by another pivot pin 48. In this way the connecting link 44 connects the driving link 32 to the driven link 38.

Further FIG. 3 shows a pair of spaced stationary contacts 16*a*1 and 16*a*2 supported by supports (not shown) to separably engage both the contact-shaped portions at both ends of the movable contactor 42 respectively.

The arrangement of FIG. 3 operates as follows: When the driving shaft 30 starts to be rotated counterclockwise as viewed in FIG. 3, i.e. in the direction of the arrow A shown in FIG. 3, to rotate the driving link 32 in the same direction as the driving shaft 30, the connecting link 44 starts to be rotated in a clockwise direction as viewed in FIG. 3, i.e. in the direction of the arrow B shown in FIG. 3, about the axis of the pivot pin 46. Simultaneously the slide 34 pivotally secured to the other end of the connecting link 44 passes through a position where it lies on a straight line including the axis of the driving shaft 30 and the pin 46. After that time, the slide 34 starts to be moved along the guide groove 32*a* in the direction of the centrifugal force on the rotating driving link 32 or in the direction of the arrow C shown in FIG. 3.

At this time, the spring 36 imparts a rotational force to the driven link 38 through the connecting link 44 tending to rotate the driven link 38 in a counterclockwise direction as viewed in FIG. 3 or in the direction of the arrow D shown in FIG. 3 about the second center of rotation 40. Thus the movable contactor 42 is maintained engaged with the stationary contacts 16*a*1 and 16*a*2.

Figure 4:
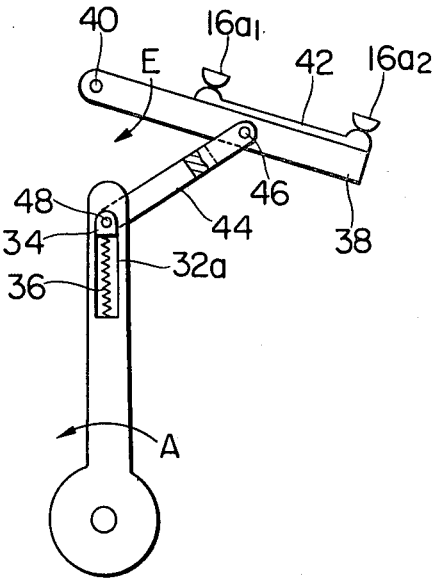
FIG. 4 is a view similar to FIG. 3 but illustrating an intermediate stage of operation of the embodiment shown in FIG. 3.

The driving link 32 is further rotated in the counterclockwise direction until the slide 34 reaches that end of the guide groove 32*a* farthest from the driving shaft 30 as shown in FIG. 4. At that time the driven link 38 starts to be rotated in a clockwise direction as viewed in FIG. 4, i.e. in the direction of the arrow E shown in FIG. 4 about the second center of rotation 40. Thus the movable contactor 42 is disengaged from the stationary contacts 16*a*1 and 16*a*2 resulting in the opening of the movable contactor 42.

When the driving shaft 32 is further rotated in the counterclockwise direction from its position shown in FIG. 4, the driven link 38 is rotated in a clockwise direction as viewed in FIG. 4 to increase the distances between the movable contractor 42 and the stationary contacts 16*a*1 and 16*a*2. The movable contactor 42 eventually reaches its final position as shown in FIG. 5.

It is now assumed that the clockwise rotational movement of the driving link 32 as described above is effected in a direction to divert the load current from the tap 12 to the tap 14 as shown in FIGS. 1 and 2A. Under the assumed conditions, it is seen from the operation as described above in conjunction with FIGS. 3, 4 and 5 that the arrangement of FIG. 3 can provide a contact switching device suitable for the first stationary contact 16*a* of the diverter switch 16 having the switching sequence illustrated in FIG. 2A. In other words the stationary contacts 16*a*1 and 16*a*2 form one half the diverter switch 16 as shown in FIG. 1 in the form of the movable contactor 42.

Figure 5:
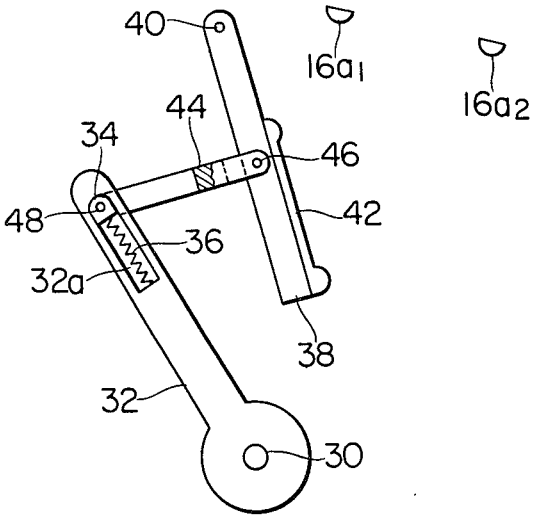
FIG. 5 is a view similar to FIG. 3 but illustrating the final stage of operation of the embodiment shown in FIG. 3.
Figure 6:
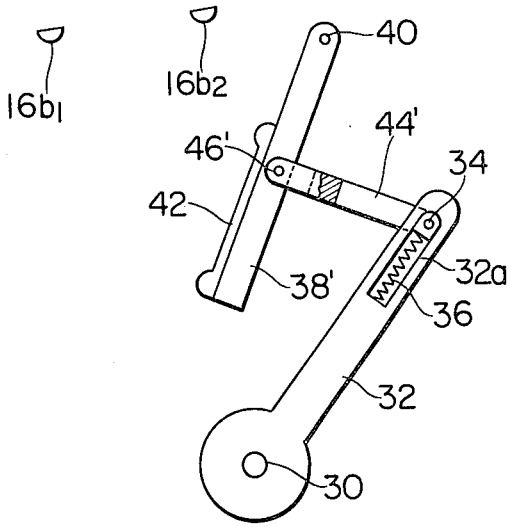
FIG. 6 is a front plan view of a modification of the present invention in which some components shown in FIG. 6 are disposed in symmetric relationship with the same componenets shown in FIG. 3 in the final stage of operation.

The arrangement of FIG. 3 may be modified to that shown in FIG. 6. In FIG. 6, the driven link 38', the movable contactor 42', and the connecting link 44' at their final positions are located so as to be symmetrical with the corresponding components as shown in FIG. 5 about a line bisecting a line connecting the axes of the driving shafts 30 in the two figures. Also a pair of stationary contacts 16*b*1 and 16*b*2 identical to those shown in FIGS. 3, 4 and 5 are disposed in symmetrical relationship with the contacts 16*a*1 and 16*a*2 about the same line.

Thus the arrangement of FIG. 6 has the reverse operation from that shown in FIGS. 3, 4 and 5, and therefore the same can provide a contact switching device for the stationary contact 16*b* as shown in FIG. 1 having the switching sequence illustrated in FIG. 2B. In other words, the stationary contacts 16*b*1 and 16*b*2 form the other half of the transfer switch 16 with the movable contactor 42'.

Figure 7:
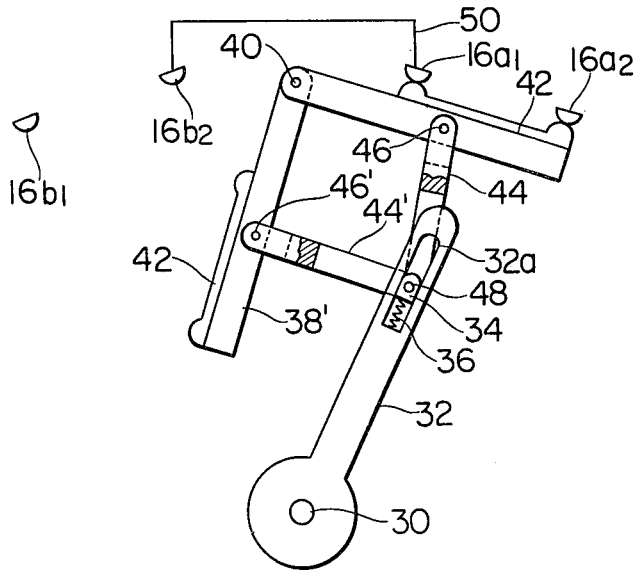
FIG. 7 is a front plan view of another modification of the present invention in which the arrangement shown in FIG. 3 is operatively associated with that shown in FIG. 6.

In FIG. 7 wherein like reference numerals designate the components identical to those shown in FIGS. 3 and 6, there is illustrated another modification of the present invention. The arrangement illustrated is different from that shown in FIG. 3 only in that in FIG. 7 a pair of driven links are operatively coupled to the single driving link through respective connecting links. More specifically, a pair of driven links 38 and 38' are equal in length to each other and pivotally secured at one end to the second center of rotation 40 and a pair of movable contactors 42 identical to each other are fixed to the free end portions of the driven links 38 and 38' respectively. Also a pair of connecting links 44 and 44' are pivotally secured at one end to intermediate points equidistant from the center of rotation40 on the driven links 38 and 38' through pivot pins 46 and 46' respectively and at the other ends to the slide 34 through the pivot pin 48. Furthermore the pair of stationary contacts 16*a*1 and 16*a*2 as shown in FIGS. 3 and 5 are disposed symmetrical with the pair of the stationary contacts 16*b*2 and 16*b*1 as shown in FIG. 6 about a line connecting the axis of the driving shaft 30 to the second center of rotation 40 with the contact 16*a*1 connected to the contact 16*b*2 through a lead 50.

Thus the arrangement of FIG. 7 is formed of that shown in FIG. 3 combined with that illustrated in FIG. 6 so that a single driving link 32, a single slide 34 and a single compressible spring 36 are operatively coupled to both the driven links 38 pivotable about the single center of rotation 40 through the respective connecting links 44 and 44'. This results in a simpler, more economical and compact structure including a combination of simple mechanical elements such as the links, the springs etc. Furthermore the driving link 32 is only rotated through a small angle to cause the contacts to be switched in accordance with a switching sequence including the closure followed by the opening and then the opening followed by the closure. Also the contact separating distance is large.

The present invention can be utilized for various contact switching devices. This is because the guide groove 32*a*, and the connecting links 44 and 44' can vary in length and the central distances between the center of rotation 40 for the driven links 38 and 38' and the pivots 46 and 46' on the connecting links 44 and 44' can vary to change operating points where the contacts are closed and opened, and the contact separating distance and other features.

Figure 8A:
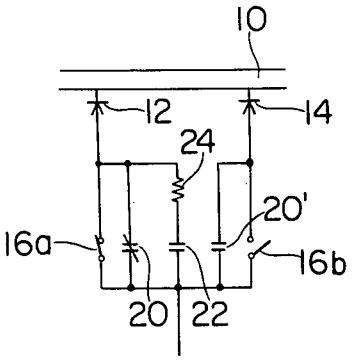
FIG. 8A is a circuit diagram of an on-load tap changer including the contact switching device of the present invention used as a diverter switch thereof.

For example, the present invention can be utilized as a diverter switch for a current carrying contact in a change-over switch for an on-load tap changer or a diverter switch for a tap selector. FIG. 8A shows one example of such a current carrying contact in a change-over switch. The arrangement illustrated comprises a tapped transformer winding 10, and odd-numbered tap 12 connected to the tapped winding 10, an odd-numbered current carrying contact pair 16*a* connected in series to the tap 12 and in parallel to both an odd-numbered arcing contact pair 20 and a series combination of a resistance contact pair 22 and a current limiting resistor 24, and a parallel combination of an even-numbered arcing contact pair 20' and an even-numbered current carrying contact pair 16*b* connected to the even-numbered tap 14.

The contact pair 16*a* and 16*b* can be formed by the arrangement shown in FIG. 7.

Figure 8B:
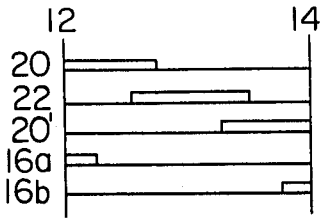
FIG. 8B is a graph illustrating the switching sequence for the arrangement shown in FIG. 8A.

FIG. 8B shows the change-over sequence for the arrangement of FIG. 8A.

Figure 9A:
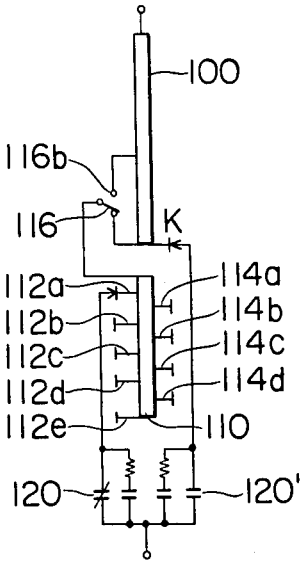
FIG. 9A is a diagram similar to FIG. 8A but illustrating an on-load tap changer including the contact switching device of the present invention used as a diverter switch of the tap selector.

FIG. 9A shows one example of the present invention utilized as a diverter switch for a tap selector. In FIG. 9A a transformer includes a main winding 100 and a tapped winding 110 subsequently connected to a plurality of odd-numbered taps 112*a*, 112*b*, 112*c*, 112*d* and 112*e* and also to a plurality of even-numbered taps 114*a*, 114*b*, 114*c* and 114*d*. Those taps are selectively connected to an odd-numbered main contact pair 120 of a change-over switch connected across a series combination of a resistance contact pair and a current limiting resistor. The main winding 100 is connected at one end to a stationary contact K of the tap selector subsequently connected to an even-numbered main contact pair 120' of the change-over switch. The one end of the main winding 100 is also connected to a first stationary contact 116*a* of a diverter switch 116 for the tap selector having a second stationary contact 116*b* connected to a predetermined point on the main winding 100. Then main contact pairs 120 and 120' and the resistance contact pairs are connected together to a current utilization device (not shown).

Figure 9B:
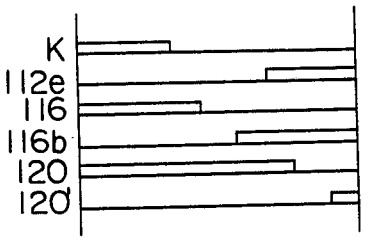
FIG. 9B is a graph illustrating the switching sequence for the arrangement shown in FIG. 9A.

FIG. 9B shows a switching sequence for the arrangement of FIG. 9A.

The present invention has the following advantages:

(1) A contact switching mechanism is provided in which the driving side is rotated through a small angle to permit the switching operation to be performed in the order of the closure, the opening, and the closure, and the contact separating distance is large.

(2) Various contact switching devices can be provided by changing the dimensions of the structural elements.

(3) The contact switching devices set forth in the above sections (1) and (2) can be obtained by combining a small number of mechanical elements such as a spring, links, etc.

(4) The contacts have little mechanical wear because the contact switching device is of the butt type.

While the present invention has been illustrated and described in conjunction with a few preferred embodiments thereof it is to be understood that numerous changes and modifications may be resorted to without departing from the spirit and scope of the present invention.

What is claimed is:

1. A contact switching apparatus comprising:

a driving link reciprocally pivotable about an axis of rotation between two end positions and having a single arm extending radially from said axis;

a driven link having one end pivoted at a pivot point spaced from said axis and extending away from said, pivot point, said driven link having a movable contactor means on the free end thereof;

a connecting link having one end pivotally connected to said driven link intermediate the ends of the driven link, and having the other end in a sliding engagement with the free end of said single arm for sliding only in the direction of the length of said driving link and having means for spring loading the point of engagement in the direction of sliding; and a stationary contact means positioned to be contacted by the movable contactor means, said driving link when it is pivoted to one end position swinging the connecting link to a position for urging the movable contactor on said driven link into contact with said stationary contact means, said position being slightly past, in a direction away from said pivot point, the dead center position of said driving link and said connecting link in which said driving link and said connecting link are aligned between said axis and the pivotal connection of said connecting link to said driven link, and when it is pivoted to the other end position swinging the connecting link to a position for spacing the movable contactor means on said driven link away from the said stationary contact means, and said driving link when it is in said other end position being substantially at right angles to said connecting link.

2. A contact switching device as claimed in claim 1 wherein said driving link is provided on the other end portion with a guide groove extending longitudinally thereof, a slide is slidably disposed within said guide groove, and said connecting link has the other end pivotally secured to said slide.

3. A contact switching device as claimed in claim 2 wherein a resilient member is disposed in said guide groove on said driving link to tend to push said slide toward the other end of said driving link.

4. A contact switching apparatus comprising:

a driving link reciprocally pivotable about an axis of rotation between two end positions and having a single arm extending radially from said axis;

a pair of driven links each having one end pivoted at a single pivot point spaced from said axis and diverging away from said single pivot point, said driven links each having a movable contactor on the free end thereof;

a pair of connecting links each having one end pivotally connected to a corresponding one of said driven links intermediate the ends of the driven link, and having the other ends in a sliding, spring-loaded engagement with the free end of said single arm; and a pair of stationary contact means positioned to be contacted by the respectively movable contactors, said driving link when it is pivoted to one end position swinging the connecting link for one of said driven links to a position for urging the movable contactor on said one driven link into contact with one of said stationary contact means, said position being slightly past, in a direction away from said pivot point, the dead center position of said driving link and said one connecting link in which said driving link and said one connecting link are aligned between said axis and the pivotal connection of said one connecting link to said one driven link, and said driving link swinging the connecting link for the other of said driven links to a position for spacing the movable contactor on said other driven link away from the other of said stationary contact means, and said driving link when it is pivoted to the other end position swinging the connecting link for the other of said driven links to a position for moving the movable contactor on said other driven link into contact with the other of said stationary contact means, said position being slightly past, in a direction away from said pivot point, the dead center position of said driving link and the other connecting link in which said driving link and said other connecting link are aligned between said axis and the pivotal connection of said other connecting link to said other driven link, and said driving link swinging the connecting link for said one driven link to a position for spacing the movable contactor on said one driven link away from said one stationary contact means.

* * * * *